US009415889B2

(12) United States Patent
Albert et al.

(10) Patent No.: US 9,415,889 B2
(45) Date of Patent: Aug. 16, 2016

(54) FULLY AUTOMATED BAG PREPARING SYSTEM FOR VARIOUS TYPES OF BAGS

(71) Applicant: PREMIER TECH TECHNOLOGIES LTEE, Riviere-du-Loup (CA)

(72) Inventors: Andre Albert, Riviere-du-Loup (CA); Steeve Santerre, Riviere-du-Loup (CA)

(73) Assignee: PREMIER TECH TECHNOLOGIES LTEE, Riviere-du-Loup, Quebec (CA)

( * ) Notice: Subject to any disclaimer, the term of this patent is extended or adjusted under 35 U.S.C. 154(b) by 660 days.

(21) Appl. No.: 13/814,409

(22) PCT Filed: Sep. 24, 2012

(86) PCT No.: PCT/CA2012/050669

§ 371 (c)(1),
(2) Date: Feb. 5, 2013

(87) PCT Pub. No.: WO2013/040717

PCT Pub. Date: Mar. 28, 2013

(65) Prior Publication Data

US 2014/0075896 A1 Mar. 20, 2014

Related U.S. Application Data

(60) Provisional application No. 61/538,338, filed on Sep. 23, 2011.

(51) Int. Cl.

| | |
|---|---|
| ***B65B 43/44*** | (2006.01) |
| ***B65B 43/46*** | (2006.01) |
| ***B65B 57/04*** | (2006.01) |

(52) U.S. Cl.
CPC ..... *B65B 43/44* (2013.01); *B65B 43/465* (2013.01); *B65B 57/04* (2013.01)

(58) Field of Classification Search
USPC ..... 53/544
See application file for complete search history.

(56) References Cited

U.S. PATENT DOCUMENTS 5,515,599 A * 5/1996 Best ..... 29/705
7,293,591 B2 * 11/2007 Nakagawa et al. ..... 156/362

(Continued)

FOREIGN PATENT DOCUMENTS

DE 102008009803 B3 * 4/2009
EP 1452447 A2 9/2004

(Continued)

OTHER PUBLICATIONS

Title: Articulated robots win points for flexibility and dexterity Author: Dennis Seeds Date Published: Jan. 2008 Date Accessed: Jul. 7, 2015 Web address: http://www.toolingandproduction.com/features/2008_January/0108_coverstory.aspx.*

(Continued)

*Primary Examiner* — Hemant M Desai
*Assistant Examiner* — Tanzim Imam
(74) *Attorney, Agent, or Firm* — Merchant & Gould P.C.

(57) ABSTRACT

A displacement device is for preparing a bag for its installation at a filling point (or second location) of packaging equipment. The displacement device grabs the bag from the pick-up location (or stack) (at which first position and orientation parameters have been previously measured), displaces the bag while measuring second position and orientation parameters of the bag, adjusting the operation and displacement of the displacement device for displacing and installing the bag at the filling point; at the same time, the measurement of the next bag's first position and orientation parameters is done to adjust the operation and displacement of the displacement device for grabbing the next bag on the stack. Such a double location evaluation, which is concomitant on two different bags, allows savings in processing time.

30 Claims, 3 Drawing Sheets

(56) References Cited

U.S. PATENT DOCUMENTS

| | | | | |
|---|---|---|---|---|
| 7,581,370 | B2 | 9/2009 | Koga | |
| 8,490,367 | B2 | 7/2013 | Actis | |
| 2005/0198804 | A1* | 9/2005 | Koren | 29/430 |
| 2010/0083475 | A1* | 4/2010 | Iwasaki | B65B 15/04 29/283 |
| 2010/0126118 | A1 | 5/2010 | Actis | |
| 2010/0281822 | A1 | 11/2010 | Murray | |
| 2013/0067870 | A1 | 3/2013 | Actis | |
| 2013/0283730 | A1 | 10/2013 | Actis | |

FOREIGN PATENT DOCUMENTS

| | | | |
|---|---|---|---|
| EP | 2088082 | A1 | 8/2009 |
| WO | WO 2011/075816 | A1 | 6/2011 |

OTHER PUBLICATIONS

International Search Report for corresponding International Patent Application No. PCT/CA2012/050669 mailed Dec. 6, 2012.

* cited by examiner

FULLY AUTOMATED BAG PREPARING SYSTEM FOR VARIOUS TYPES OF BAGS

FIELD OF THE INVENTION

The present invention relates to equipment for packaging bulk products in the food, pet food, feed, seed and chemical industries to name a few. More particularly, the present invention relates to a system which is responsible for preparing the bag for its installation at the filling point of packaging equipment.

BACKGROUND OF THE INVENTION

In the packaging industry, over the last few years, there has been an important evolution of the types of materials (such as polyethylene, polypropylene, biodegradable plastic, recycled plastic, paper, etc. . . . ) and types of construction (such as inner liner, woven, special printing, coating, etc. . . . ) to name a few, used to make bags. This has led to a wide range of bags that are more or less flexible and more or less porous, which must be declined in an extensive variation of bag sizes to fit the different industries and ever-growing market requirements. Furthermore, over the last decade, globalization of bag suppliers into the packaging market, introduced bags of a great variability of quality. This gave rise to high quality bags, but also low quality bags (such as bags stuck together, damaged, poorly stacked and varying in dimensions for a given size). Overall, the evolution of the context resulted in considerable variability of bags.

Paradoxically, in conjunction with the arrival on the market of this wide variety of empty bags, expectations in terms of finished filled bags quality (namely in terms of appearance) are constantly increasing along with the desire to have single automatic equipment to process most types of bags as possible, ideally all types.

Of course, automated packaging equipment is constructed to be as efficient as possible in a given application. For the sake of cost optimization, it is common for producers to try to stretch the scope of their equipment, leading often to bags with defaults or rejected bags (during the packaging or later in the process), mostly coming from bags that have not been well prepared before the filling step. Such a miss preparation may result in improperly filled bags as well as improperly sealed (non-hermetic) bags which can cause quality problems in terms of hygiene, preservation and contamination, as well as in terms of appearance of the filled finished bags, ultimately resulting in producers' or customers' dissatisfaction.

It is important to remember that there are four major steps involved in packaging equipment used to bag bulk products: 1) preparing, 2) filling, 3) sealing and 4) evacuating the bag. The present invention mainly relates to the preparing step, which is responsible for executing the following basic actions:

Grabbing,
Conditioning,
Unstacking,
Opening,
Transporting, and
Installing the bag on the filling point.

Some of these actions can be switchable or combined from one equipment to another, along with an optional action, forming the bag, which is only necessary in some applications (for example with equipment using film rolls).

Initially, packaging of products intended for the food, pet food, feed, seed and chemical industries, to name a few, was done manually. Later, the automation of packaging equipment began in order to reduce health and safety issues as well as costs related to labor, while accelerating the packaging process and making it more consistent, providing a better quality as much as possible.

Progressively, the automation of packaging equipment was applied to all four steps of packaging. Initially, it has been done through systems with limited degrees of freedom implying displacement of a bag from an initial point to a final point, including the accomplishment of different actions, according to pre-defined, invariable and back and forth movements usually realized by dedicated devices. As used herein, the term "degrees of freedom" is related to the robot (or displacement device) movements associated to its rotation axes which result in flexibility. Refer to FIG. 1A showing a prior art system for a better understanding of the different principles involved.

Later, in order to gain flexibility of movements, the automation of packaging equipment has gone to systems with more degrees of freedom. These systems started to automate different packaging steps, as seen in patent application PCT/CA2010/001940 which describes a system automating the closing step, or U.S. Ser. No. 61/382,279 which describes a system automating the filling step.

Considering the complexity of preparing bags which can vary in type of material, type of construction, size and quality, the automation of the preparing step has become a challenge. In fact, the use of 3 to 4 degrees of freedom systems (in the preparing step) operate in limited applications since they can hardly efficiently handle porous, flexible, poorly stacked and/or bag of varying dimensions (for a given size).

Later, in order to handle a greater range of bags, the automation of the preparing step started to be done using systems with 5 to 6 degrees of freedom. In existing baggers, mostly open-mouth baggers, the preparing step including the accomplishment of specific required actions, usually implies the displacement of an empty bag from an initial point to a final point (filling point), integrating one (or many) location evaluation of the bag allowing a correction of the bag location or location of the gripping device taking the bag which are equivalent since both types of correction result in a correction preceding a defined movement. In fact, the goal is to correct the location of the bag in order to move it in a known (and defined) location and displace it according to pre-defined, invariable and back and forth movements realized most of the time by various dedicated devices. These dedicated devices grab the bag in a defined location and transfer it to another dedicated device (in a defined location). Since location evaluation is very complex to achieve on a stack of bags, there is a need to combine it with an upstream dedicated unstacker to bring only one bag in a known (and defined) location. Despite the fact that such system is more tolerant to variations in dimensions (for a given size), these 5 to 6 degrees of freedom systems do not provide improvements concerning efficient handling of porous and flexible bags. To achieve an efficient handling, such equipment would require the addition of new devices in terms of unstacking and location evaluation. This would prevent, for example, softer bags from deforming and make the system more effective with a large variety of stacked bags. Consequently, it would make this machine much too expensive and complex.

By analysing the prior art, one can notice that in the field of automation of packaging equipment, it has been difficult to find an effective way to automate the preparing step in order to deal with large variety of bags including more porous, flexible, poorly stacked and/or bags varying in dimensions (for a given size); while being able to provide a finished filled bag fulfilling an expected quality at high speed.

Therefore, there are presently needs for a simple, fully automated and rapid automated system (with 5 to 6 degrees of freedom) for better preparing bags by exploiting deeper all the existing degrees of freedom in order to process different types of bags and providing finished filled bags of expected quality and less rejected bags.

SUMMARY OF THE INVENTION

The present invention addresses at least one of the above-mentioned needs.

According to the present invention, there is provided a bag preparing system for processing in packaging equipment including:

- a displacement device for displacing the bag between a pick-up location and a second location, the displacement device comprising a gripper for gripping the bag during displacement thereof;
- a first measurement system for measuring, at the pick-up location, a pick-up position parameter indicative of a pick-up location of the bag, and for generating a first signal indicative of the pick-up position parameter;
- a second measurement system for measuring, at an intermediate location between the pick-up location and the second location, at least one of an intermediate position parameter and an intermediate orientation parameter indicative of an intermediate position and orientation of the bag, and for generating a second signal indicative of said at least one of the intermediate position and orientation parameters; and
- a controller for controlling operation and displacement of the displacement device, said controller adjusting operation and displacement of the displacement device for gripping the bag at the pick-up location based on the first signal, and for displacing the bag towards the second location based on the second signal.

Preferably, the displacement device is a 5 or 6 degrees of freedom system.

Preferably, according to a first preferred embodiment, the displacement device is a robot.

Preferably, according to another preferred embodiment, the displacement device is a dedicated 5 or 6 degrees of freedom system.

Preferably, the present invention provides a displacement device which is responsible for preparing the bag for its installation at a filling point (or second location) of packaging equipment. The displacement device grabs the bag from the pick-up location (or stack) (from which first position and orientation parameters have been previously measured), displaces the bag while measuring second position and orientation parameters of the bag, adjusting the operation and displacement of the displacement device for displacing and installing the bag on the filling point; at the same time, the measurement of the next bag's first position and orientation parameters is done to adjust the operation and displacement of the displacement device for grabbing the next bag on the stack. Such a double location evaluation, which is concomitant on two different bags, allows savings in processing time.

BRIEF DESCRIPTION OF THE DRAWINGS

These and other objects and advantages of the invention will become apparent upon reading the detailed description, provided merely by way of non-limitative examples, and upon referring to the drawings in which:

FIG. 1A and FIG. 1B show the movements performing the preparation actions according to the degrees of freedom as well as position and orientation measurements, and displacement device adjustment functions.

DETAILED DESCRIPTION OF PREFERRED EMBODIMENTS

Figure 2:
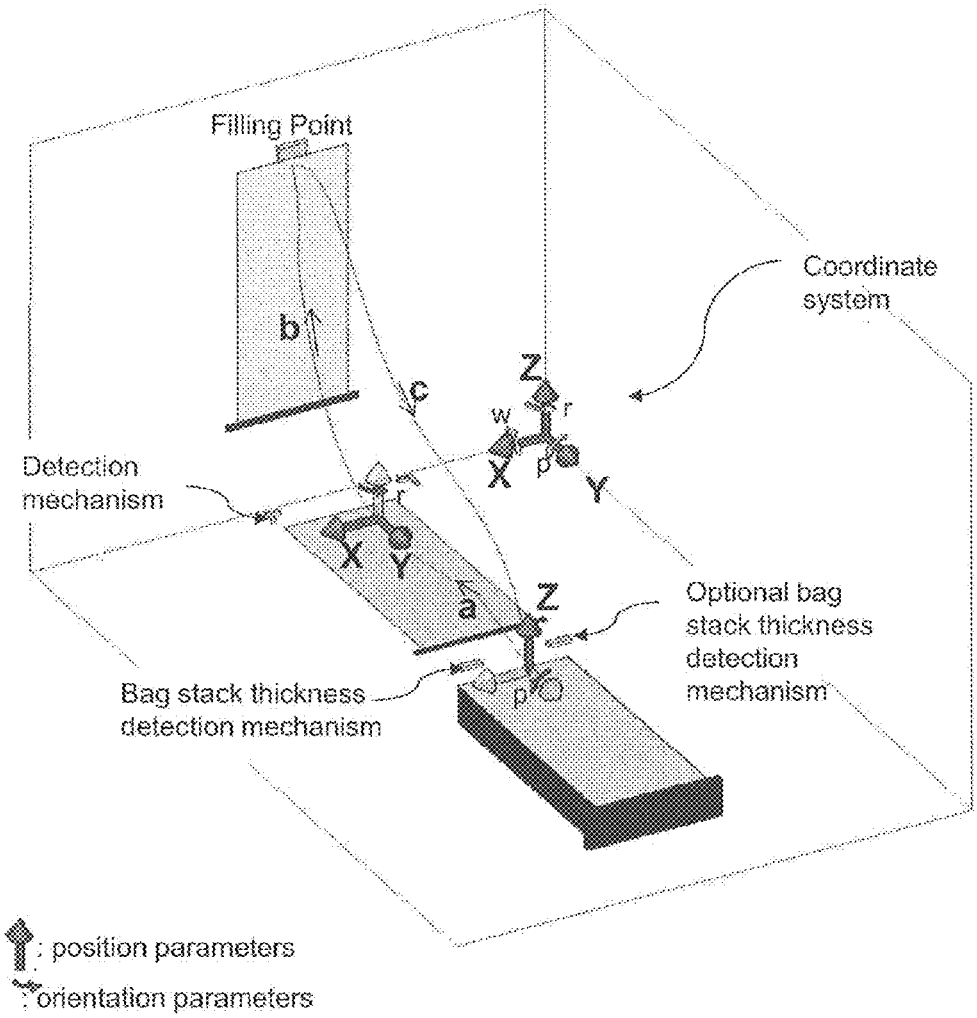
FIG. 2 is a perspective view of the cartesian coordinate system and the present invention work plan according to a preferred embodiment of the present invention.

To ease comprehension of the Cartesian axes system and the work plan of the present invention, refer to FIG. 2.

The present invention provides a 5 to 6 degrees of freedom displacement device which may be a robot or a dedicated device, coupled to a gripper, including a controller responsible for the location evaluation and correction functions; to perform the preparing step in a packaging system. Such a system implies displacement of an empty bag from an initial point (or pick-up location, that is preferably on top of the bag stack) to a filling point (second location), including the accomplishment of all bag preparing actions, based on variable and continuous movements (ideally realized by a single displacing device) specifically defined or adjusted according to the measured bag location. More specifically, such a system provides a displacement device which grabs the bag (which z position and p orientation has been previously evaluated), displaces the bag while measuring the x and y positions and r orientation, adjusts the transferring and installing movements of the bag to the filling point; at the same time, the evaluation of the next bag's z position and p orientation is done to adjust the movement responsible for grabbing this bag on the stack. Such a double location evaluation, which is concomitant on two different bags, allows savings in processing time.

As used herein, the term "location" is intended to incorporate the notion of position and orientation.

As used herein, the terms "measurement", "measured" or "to measure" are intended to include a notion of detection, calculation or evaluation of a location or any other known way of determining a location of the bag.

As used herein, the terms "adjustment", "adjusted" or "to adjust" in association with movements are intended to encompass not only adjustments but also any improvement, modification or correction of the movement of the device that may be performed during its operation.

The present invention comprises measurement systems for measuring position and orientation parameters and for generating a signal indicative of the measured position and orientation parameters, each of them allowing adjustments in the operation and displacement of the displacing device according to the previous evaluated location (or based on the signal indicative thereof). A first evaluation of the bag z position is made to detect the bag stack thickness and adjust the grabbing movement in order to take a single bag on the bag stack. In order to deal with other applications such as porous bags or mis-stacked bags, another bag stack thickness detection mechanism, to detect a different positioning of one corner of the bag stack to the other, may be added to evaluate the location of the bag in relation to the p orientation (rotation about y axis). This evaluation of the bag, before grabbing it, but while the previous bag is being displaced, is effective and saves time. A second evaluation is made to adjust the operation and displacement of the displacement device for displacing and installing of the bag at the filling point. The location of the bag-gripper ensemble in relation to the x and y position and r orientation (which is a rotation about z axis) is measured, thus allowing determining (often calculating): the location of the gripper, the location of the bag relative to the previously determined location of the gripper and the bag location relative to the filling point. Detection mechanisms (such as camera or sensors combination) are used preferably to track the contour of the bag as a positional reference. In other applications, in cases where quality (namely of impression) allow such a practice, recurring benchmarks (for example printing marks, notch, logo, etc. . . . ) may be used to detect the bag. This evaluation of the bag (x and y position and r orientation) is done while the bag is being transported towards the filling point rather than before its grabbing, which speeds up the process.

Preferably, the present invention performs two anticipated corrections adjusting the operation and displacement of the displacement device according to the previously detected bag location in order to optimize the sequence of the system. The first adjustment is made to achieve a precise and corrected grabbing movement of the bag on the stack and result in a better separation of a single bag from the stack. The second adjustment is made to achieve a precise and corrected location of the bag at the filling point and result in very few rejected bags. In the worst cases, which is when the movement correction is too important to be carried out effectively; it is possible to reject the bag at this point.

The present invention is designed to make better use of all degrees of freedom of the system by making continuous movements realized ideally by a single displacement device (instead of back and forth movements realized most of the time by various dedicated devices) to execute all the actions for preparing a bag. Instead of adding a dedicated device (for example a dedicated unstacker) and duplicating the degrees of freedom of the others dedicated devices, the unexploited degrees of freedom of the system will be used. Moreover, the fact that continuous movements executing the preparing actions are carried out ideally by a single displacement device, resulting in no (or few) bag transfer(s) from a device to another, thereby implying a better quality of finished bag.

As shown in FIG. 2, the axes x,y,z (position x, y, z) represent the three-dimensional location in the Cartesian coordinate system. The rotations w,p,r (orientations w,p,r) describes a rotation about a given axes in the Cartesian coordinate system. The bag is displaced (a) while measuring the x and y positions and r orientation, allowing adjustment of the transferring and installing movements of the bag (b) to the filling point. Measurement of the next bag z position (and optional p orientation) allowing adjustment of the movement responsible for grabbing the bag (c) on the stack.

Figure 1A:
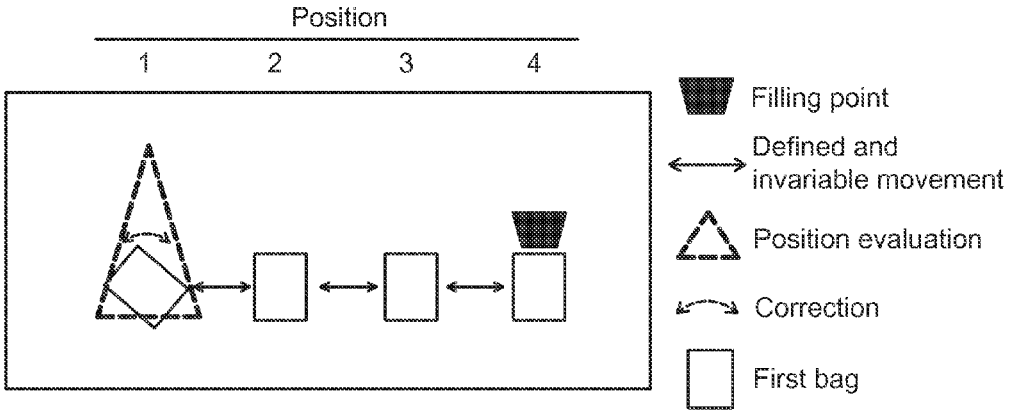
Fig. 1A (PRIOR ART)
FIG. 1A is a schematic representation of a conventional prior art bag preparing system.
Figure 1B:
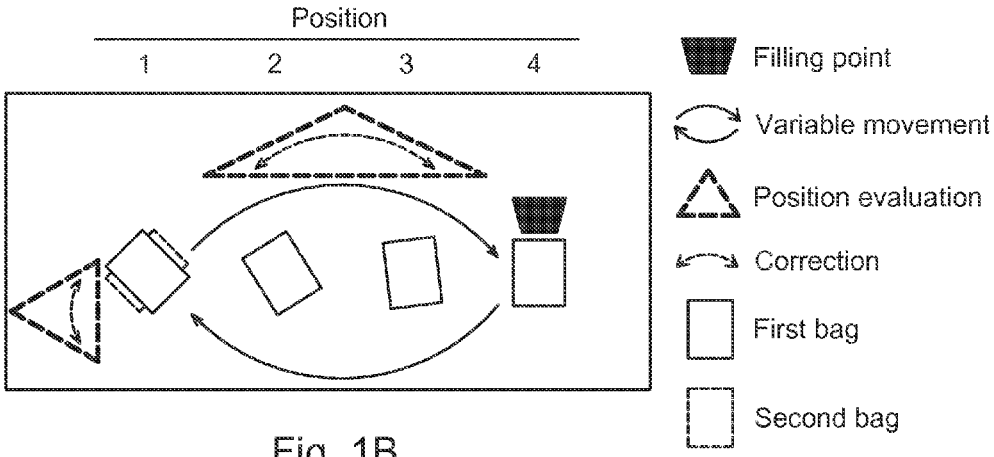
FIG. 1B is a schematic representation of a bag preparing system according to an embodiment of the present invention. Both

As shown in FIG. 1A and FIG. 1B, the systems described in the prior art, shown in FIG. 1A, displace the bag from an initial point (pick-up location) to a filling point (second location), including the accomplishment of all bag preparation actions, integrating a location measurement of the bag allowing an adjustment of the bag location (before grabbing it), according to pre-defined, invariable and back and forth movements usually performed by dedicated systems. The present invention shown in FIG. 1B displaces the bag from an initial point to a final point, including the accomplishment of all bag preparation actions, integrating a first location measurement to detect the bag stack thickness and adjust the grabbing movement in order to take a single bag as is (no matter its location) on the bag stack while a second location measurement is made on the previous bag to adjust the operation and displacement of the displacement device for displacing and installing the bag at the filling point. The corrections are carried out by variable and continuous movements (ideally realized by a single displacing device).

Figure 3:
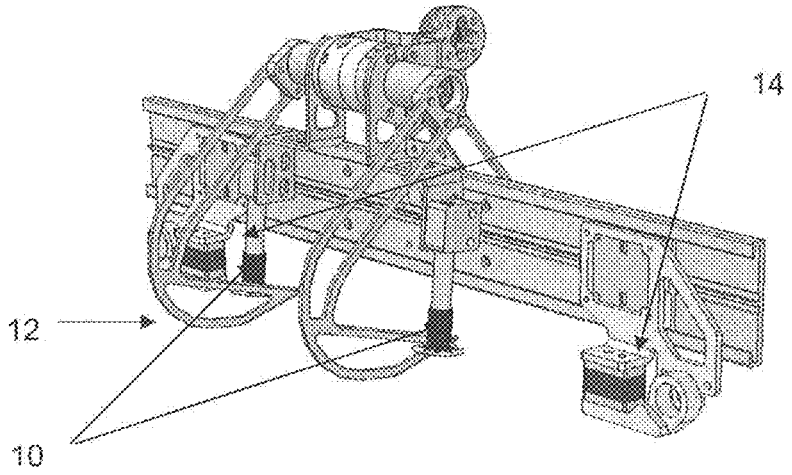
FIG. 3 is a perspective view of the system according to a preferred embodiment of the present invention, showing the gripper.

As shown in FIG. 3, the present invention provides a gripper where vacuum cups 10 are used to grab the bag on the stack, spacers 12 are used to keep the bag open during the bag's displacement and bag clamps 14 are used to manipulate and maintain a selected configuration of the bag during its displacement.

Although preferred embodiments of the present invention have been described in detail herein and illustrated in the accompanying drawings, it is to be understood that the invention is not limited to these precise embodiments and that various changes and modifications may be effected therein without departing from the scope of the present invention.

The invention claimed is:

1. A bag preparing system comprising:

a displacement device for displacing a bag while continuously holding the bag between a pick-up location and a filling point of the bag, the displacement device comprising a gripper for gripping the bag during displacement of the bag;

a first measurement system for measuring, at the pick-up location, a pick-up position parameter indicative of the pick-up location, and for generating a first signal indicative of the pick-up position parameter;

a second measurement system for measuring, at an intermediate location between the pick-up location and the filling point while the bag is held by the displacement device, at least one of an intermediate position parameter and an intermediate orientation parameter indicative of an intermediate position and an intermediate orientation of the bag, respectively, and for generating a second signal indicative of said at least one of the intermediate position parameter and the orientation parameter; and a controller for controlling operation and displacement of the displacement device, said controller adjusting the operation and the displacement of the displacement device for gripping the bag at the pick-up location based on the first signal, and for displacing the bag towards the filling point based on the second signal.

2. The bag preparing system according to claim 1, wherein the first measurement system further measures a pick-up orientation parameter indicative of a pick-up orientation of the bag and the first signal generated by the first measurement system is further indicative of the pick-up orientation parameter.

3. The bag preparing system according to claim 1, wherein the first measurement system is configured to measure a pick-up location of a next bag while the second measurement system measures the at least one of the intermediate position parameter and the intermediate orientation parameter of the bag and the displacement device displaces the bag between the pick-up location and the second location.

4. The bag preparing system according to claim 1, wherein the second measurement system comprises a detection mechanism for tracking a contour of the bag as a positional reference.

5. The bag preparing system according to claim 1, wherein at least one of the first and second measurement systems is configured to detect recurring benchmarks on the bag.

6. The bag preparing system according to claim 1, wherein the second measurement system is configured to determine a location of the gripper, a location of the bag relative to a previously determined location of the gripper, and a location of the bag relative to the filling point.

7. The bag preparing system according to claim 1, wherein the second measurement system measures the at least one of the intermediate position parameter and the intermediate orientation parameter of the bag while the displacement device displaces the bag between the pick-up location and the filling point.

8. The bag preparing system according to claim 1, wherein the pick-up location of the bag is on top of a bag stack, and wherein the first measurement system is configured to detect a thickness of the bag stack as the pick-up position parameter.

9. The bag preparing system according to claim 8, wherein the controller is configured to adjust, based on the detected thickness of the bag stack, a gripping movement of the displacement device for gripping the bag on the bag stack.

10. A bag preparing system comprising:

a displacement device for displacing a bag while continuously holding the bag between a pick-up location and a second location, the displacement device comprising a gripper for gripping the bag during displacement of the bag, the pick-up location of the bag is on top of a bag stack, a first measurement system for measuring, at the pick-up location, a pick-up position parameter indicative of the pick-up location, and for generating a first signal indicative of the pick-up position parameter, the first measurement system being configured to detect a thickness of the bag stack as the pick-up position parameter;

a second measurement system for measuring, at an intermediate location between the pick-up location and the second location while the bag is held by the displacement device, at least one of an intermediate position parameter and an intermediate orientation parameter indicative of an intermediate position and an intermediate orientation of the bag, respectively, and for generating a second signal indicative of said at least one of the intermediate position and orientation parameters, and a controller for controlling operation and displacement of the displacement device, said controller adjusting the operation and the displacement of the displacement device for gripping the bag at the pick-up location based on the first signal, and for displacing the bag towards the second location based on the second signal.

11. The bag preparing system according to claim 10, wherein the controller is configured to adjust, based on the detected thickness of the bag stack, a gripping movement of the displacement device for gripping the bag on the bag stack.

12. The bag preparing system according to claim 10, wherein the first measurement system further measures a pick-up orientation parameter indicative of a pick-up orientation of the bag and the first signal generated by the first measurement system is further indicative of the pick-up orientation parameter.

13. The bag preparing system according to claim 10, wherein the first measurement system is configured to measure a pick-up location of a next bag while the second measurement system measures the at least one of the intermediate position parameter and the intermediate orientation parameter of the bag and the displacement device displaces the bag between the pick-up location and the second location.

14. The bag preparing system according to claim 10, wherein the second measurement system is configured to determine a location of the gripper, a location of the bag relative to a previously determined location of the gripper, and a location of the bag relative to the second location.

15. The bag preparing system according to claim 10, wherein the second measurement system measures the at least one of the intermediate position parameter and the intermediate orientation parameter of the bag while the displacement device displaces the bag between the pick-up location and the second location.

16. The bag preparing system according to claim 10, wherein the first measurement system further measures a pick-up orientation parameter indicative of a pick-up orientation of the bag and the first signal generated by the first measurement system is further indicative of the pick-up orientation parameter.

17. The bag preparing system according to claim 10, wherein the first measurement system is configured to measure a pick-up location of a next bag while the second measurement system measures the at least one of the intermediate position parameter and the intermediate orientation parameter of the bag and the displacement device displaces the bag between the pick-up location and the second location.

18. The bag preparing system according to claim 10, wherein the second measurement system is configured to determine a location of the gripper, a location of the bag relative to a previously determined location of the gripper, and a location of the bag relative to the second location.

19. The bag preparing system according to claim 10, wherein the second measurement system measures the at least one of the intermediate position parameter and the intermediate orientation parameter of the bag while the displacement device displaces the bag between the pick-up location and the second location.

20. A bag preparing system comprising:

a single displacement device for displacing a bag between a pick-up location and a filling point of the bag, the displacement device comprising a gripper for gripping the bag during displacement of the bag;

a first measurement system for measuring, at the pick-up location, a pick-up position parameter indicative of the pick-up location, and for generating a first signal indicative of the pick-up position parameter;

a second measurement system for measuring, at an intermediate location between the pick-up location and the filling point, at least one of an intermediate position parameter and an intermediate orientation parameter indicative of an intermediate position and an intermediate orientation of the bag, respectively, and for generating a second signal indicative of said at least one of the intermediate position parameter and the intermediate orientation parameter; and a controller for controlling operation and displacement of the displacement device, said controller adjusting the operation and the displacement of the displacement device for gripping the bag at the pick-up location based on the first signal, and for displacing the bag towards the filling point based on the second signal.

21. The bag preparing system according to claim 20, wherein the first measurement system further measures a pick-up orientation parameter indicative of a pick-up orientation of the bag and the first signal generated by the first measurement system is further indicative of the pick-up orientation parameter.

22. The bag preparing system according to claim 20, wherein the first measurement system is configured to measure a pick-up location of a next bag while the second measurement system measures the at least one of the intermediate position parameter and the intermediate orientation parameter of the bag and the displacement device displaces the bag between the pick-up location and the filling point.

23. The bag preparing system according to claim 20, wherein the second measurement system comprises a detection mechanism for tracking a contour of the bag as a positional reference.

24. The bag preparing system according to claim 20, wherein at least one of the first and second measurement systems is configured to detect recurring benchmarks on the bag.

25. The bag preparing system according to claim 20, wherein the second measurement system is configured to determine a location of the gripper, a location of the bag relative to a previously determined location of the gripper, and a location of the bag relative to the filling point.

26. The bag preparing system according to claim 20, wherein the second measurement system measures the at least one of the intermediate position parameter and the intermediate orientation parameter of the bag while the displacement device displaces the bag between the pick-up location and the filling point.

27. The bag preparing system according to claim 20, wherein the pick-up location of the bag is on top of a bag stack, and wherein the first measurement system is configured to detect a thickness of the bag stack as the pick-up position parameter.

28. The bag preparing system according to claim 27, wherein the controller is configured to adjust, based on the detected thickness of the bag stack, a gripping movement of the displacement device for gripping the bag on the bag stack.

29. A bag preparing system comprising:

a single displacement device for displacing a bag between a pick-up location and a second location, the displacement device comprising a gripper for gripping the bag during displacement of the bag, the pick-up location of the bag being on top of a bag stack, a first measurement system for measuring, at the pick-up location, a pick-up position parameter indicative of the pick-up location, and for generating a first signal indicative of the pick-up position parameter, the first measurement system being configured to detect a thickness of the bag stack as the pick-up position parameter;

a second measurement system for measuring, at an intermediate location between the pick-up location and the second location, at least one of an intermediate position parameter and an intermediate orientation parameter indicative of an intermediate position and an intermediate orientation of the bag, respectively, and for generating a second signal indicative of said at least one of the intermediate position and the orientation parameters; and a controller for controlling operation and displacement of the displacement device, said controller adjusting the operation and the displacement of the displacement device for gripping the bag at the pick-up location based on the first signal, and for displacing the bag towards the second location based on the second signal.

30. The bag preparing system according to claim 29, wherein the controller is configured to adjust, based on the detected thickness of the bag stack, a gripping movement of the displacement device for gripping the bag on the bag stack.

* * * * *